US010611549B1

(12) United States Patent
Mahon

(10) Patent No.: US 10,611,549 B1
(45) Date of Patent: Apr. 7, 2020

(54) SANDWICH CONTAINER

(71) Applicant: Joseph Mahon, Brea, CA (US)

(72) Inventor: Joseph Mahon, Brea, CA (US)

( * ) Notice: Subject to any disclaimer, the term of this patent is extended or adjusted under 35 U.S.C. 154(b) by 147 days.

(21) Appl. No.: 15/687,344

(22) Filed: Aug. 25, 2017

(51) Int. Cl.

| | |
|---|---|
| ***B65D 21/02*** | (2006.01) |
| ***B65D 81/32*** | (2006.01) |
| ***B65D 25/04*** | (2006.01) |
| *B65D 1/26* | (2006.01) |

(52) U.S. Cl.
CPC ..... *B65D 81/32* (2013.01); *B65D 25/04* (2013.01); *B65D 1/26* (2013.01)

(58) Field of Classification Search
CPC .... B65D 81/32; B65D 25/04; B65D 81/3294; B65D 81/34; B65D 81/3446; B65D 81/3453
USPC ..... 220/4.27, 4.26, 4.22, 4.23, 574.3, 573.3, 220/495.03, 23.9, 23.2, 23.8, 23.86, 531, 220/825, 837, 520, 522
See application file for complete search history.

(56) References Cited

U.S. PATENT DOCUMENTS

| | | | | | |
|---|---|---|---|---|---|
| 3,567,013 | A * | 3/1971 | Tannebaum | B65D 75/225 | 206/538 |
| 3,999,661 | A * | 12/1976 | Jones | B65D 81/027 | 206/591 |
| 4,532,397 | A * | 7/1985 | McClelland | A47G 19/02 | 219/733 |
| 4,844,330 | A * | 7/1989 | Roosa | B65D 5/48024 | 229/120.06 |
| 4,951,866 | A | 8/1990 | Rusnak | | |
| 4,964,526 | A * | 10/1990 | Stephens | A45C 11/24 | 132/315 |
| 5,012,971 | A | 5/1991 | Cozzi et al. | | |
| 5,240,134 | A * | 8/1993 | McDermott | B65D 25/16 | 217/3 R |
| 5,300,748 | A * | 4/1994 | Colombo | B65D 11/16 | 219/734 |
| 5,323,898 | A * | 6/1994 | Kester | B65D 25/10 | 206/709 |
| 5,890,596 | A * | 4/1999 | Albisetti | B65D 81/3294 | 206/557 |
| 6,574,834 | B2 * | 6/2003 | Fedon | A45C 13/007 | 16/225 |
| 7,968,132 | B2 * | 6/2011 | Archie, Jr. | A45C 11/20 | 206/541 |
| D668,555 | S | 10/2012 | Archie, Jr. et al. | | |
| 9,038,840 | B2 | 5/2015 | Umholtz | | |
| 2004/0217023 | A1 * | 11/2004 | Fagg | B65D 25/04 | 206/242 |
| 2005/0155966 | A1 * | 7/2005 | Mantis | B65D 43/162 | 220/4.23 |

(Continued)

*Primary Examiner* — Robert Poon
(74) *Attorney, Agent, or Firm* — Eric Karich; Karich & Associates

(57) ABSTRACT

A sandwich container has an upper shell and a lower shell connected by a hinge so that the upper shell can pivot with respect to the lower shell between an open configuration and a closed configuration. The sandwich container further includes an elongate hinge flap that connects the lower shell and a divider panel, the elongate flap having a length that is great enough so that the divider panel can pivot between a raised configuration wherein the divider panel is outside of the lower shell, and a lowered configuration wherein a divider perimeter is seated against the lower shell beneath of the lower perimeter.

3 Claims, 3 Drawing Sheets

(56) References Cited

U.S. PATENT DOCUMENTS

| | | | | |
|---|---|---|---|---|
| 2009/0042705 | A1 | 2/2009 | Maslowski et al. | |
| 2011/0121002 | A1 | 5/2011 | Stiller | |
| 2011/0215097 | A1 | 9/2011 | Archie, Jr. et al. | |
| 2017/0291737 | A1* | 10/2017 | Pierce ..... | B65D 51/1611 |

* cited by examiner

SANDWICH CONTAINER

BACKGROUND OF THE INVENTION

Field of the Invention

This invention relates generally to food containers, and more particularly to a sandwich container that includes multiple compartments for separating the various ingredients of the sandwich during sale and transport.

Description of Related Art

The prior art teaches a variety of containers for holding sandwiches. For example, Archie J R, U.S. 2011/0215097, teaches a dual compartment sandwich container that includes a top half and a bottom half, as well as a flexible divider for separating a lower compartment of the container from an upper compartment. The divider contacts the perimeter of the lower half, to form a seal that closes the lower compartment. The container further includes a removable tray for covering a heating element in the lower half, for keeping the sandwich hot. The flexible divider also includes a flexible wall connecting the transverse member to the rim. The flexible wall is configured to facilitate movement of the transverse member from an upper stable position to a lower stable position. See also related design patent U.S. D668555, and granted Utility patent U.S. Pat. No. 7,968,132.

Rusnak, U.S. Pat. No. 4,951,866, teaches a container that includes a removably insert for separating the container into first and second compartments. In the closed position, the second compartment is on top of the first compartment. The insert is removable when the container is closed and includes a support tab that is insertable into a slot in the container to restrain movement of the insert and to distribute forces through the sidewalls of the container. Cozzi, U.S. Pat. No. 5,012,971, teaches a similar container.

Maslowski, U.S. 2009/0042705, teaches a multi-compartment container for holding food for use in a microwave. The container includes multiple compartments, which may include a top compartment that is shielded against microwaves, so that the contents of the top compartment are not warmed in the microwave.

Umholtz, U.S. Pat. No. 9,038,840, teaches a multi-compartmented food storage device having a top hermetic storage compartment, a bottom hermetic storage compartment and a central hermetic storage compartment that is interposed there between. Each of the top and bottom compartments being hingedly secured to the central compartment along an upper and lower end.

The prior art teaches a sandwich container that includes upper and lower shells for containing a sandwich like a hamburger, and which include a divider that is mounted over a perimeter of the lower shell for separating the sandwich into two groups of component ingredients. However, the prior art does not teach such a sandwich container includes a divider panel that is positioned within the lower shell, and seats beneath the perimeter of the lower shell. The present invention fulfills these needs and provides further advantages as described in the following summary.

SUMMARY OF THE INVENTION

The present invention teaches certain benefits in construction and use which give rise to the objectives described below.

The present invention provides a sandwich container that has an upper and a lower shell connected by a hinge, which allows the upper shell to pivot with respect to the lower shell between an open configuration and a closed configuration. The sandwich container further includes an elongate hinge flap that connects the lower shell and a divider panel, the elongate flap having a length that is great enough so that the divider panel can pivot between a raised configuration wherein the divider panel is outside of the lower shell, and a lowered configuration wherein a divider perimeter is seated against the lower shell beneath of the lower perimeter.

A primary objective of the present invention is to provide a sandwich container having advantages not taught by the prior art.

Another objective is to provide a sandwich container that is able to separate ingredients of a sandwich into two compartments, so that meat, cheese, and similar ingredients are maintained hot and separate from other ingredients such as bread, lettuce, tomatoes, and similar ingredients.

Another objective is to provide a sandwich container that includes a divider panel that is positioned within the lower shell, and seats beneath the perimeter of the lower shell.

A further objective is to provide a sandwich container that thermally insulates the meat, cheese, and similar ingredients, so that they may remain hot for longer periods of time.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above-described drawing figures illustrate the invention, a sandwich container for storing a sandwich such as a hamburger, or any other similar food product that include both a bread and/or vegetable component, as well as a second meat and/or cheese component. For purposes of this application, the term "sandwich" includes any form of sandwich, hamburger, hot dog, chicken or fish sandwich, and related food products that are typically adapted to be eaten by hand.

Figure 1:
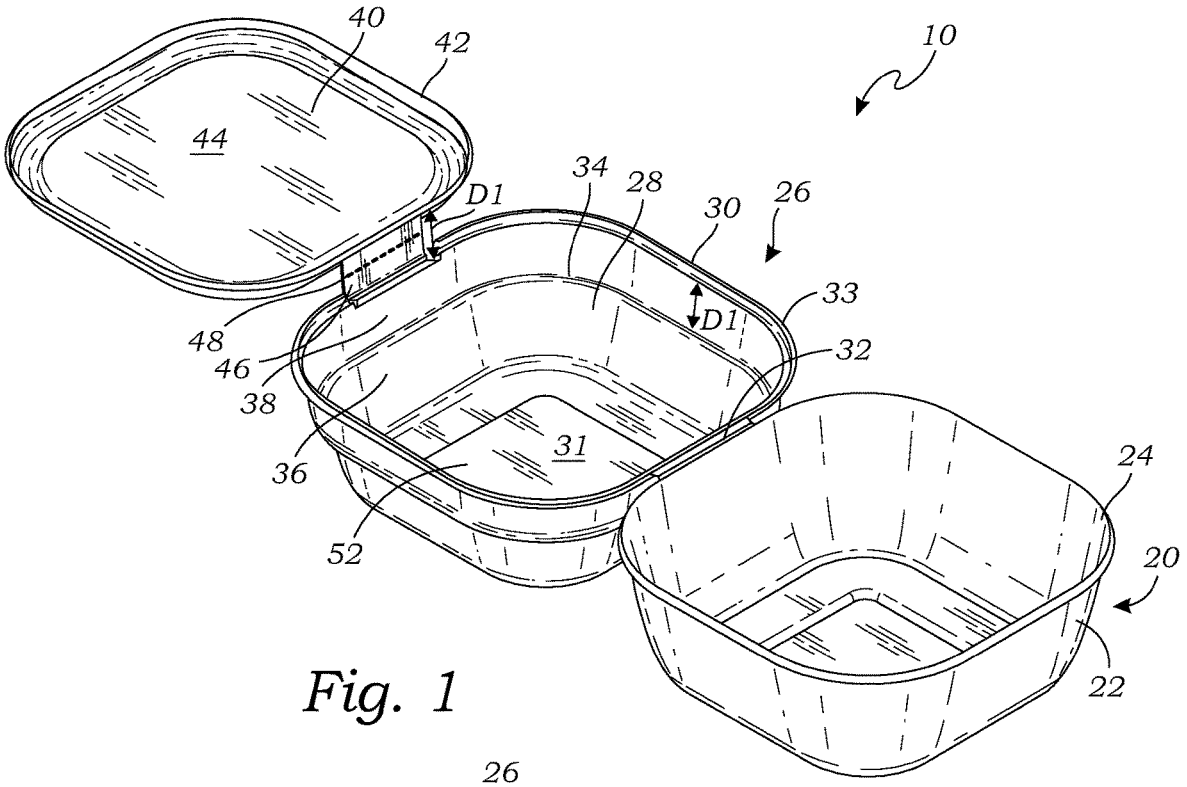
FIG. 1 is a perspective view of a sandwich container according to a first embodiment of the present invention, illustrating upper and lower shells in an open configuration, and a divider panel in a raised configuration.
Figure 2:
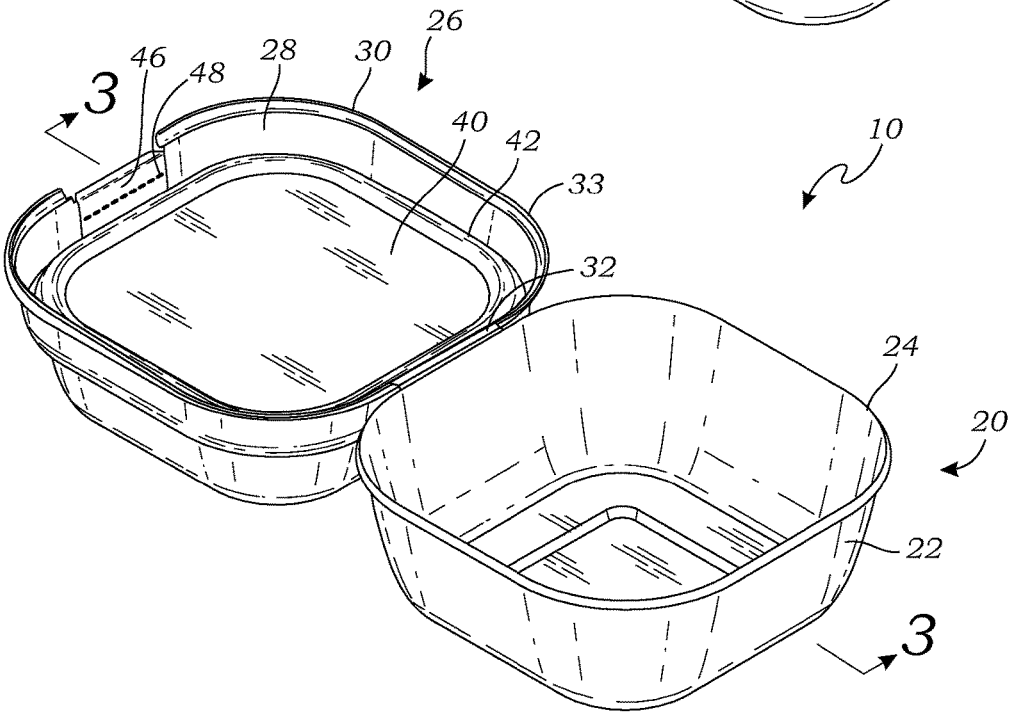
FIG. 2 is a perspective view thereof, illustrating the divider panel moved to a lowered configuration.
Figure 3:
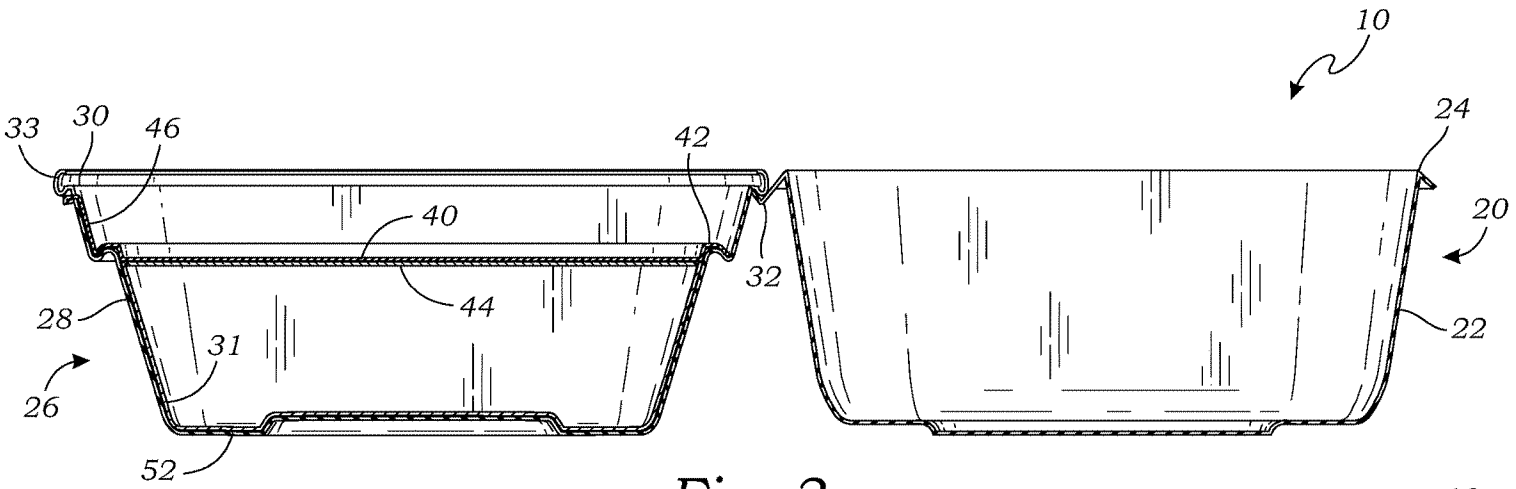
FIG. 3 is a sectional view thereof taken along line 3-3 in FIG. 2.
Figure 5:
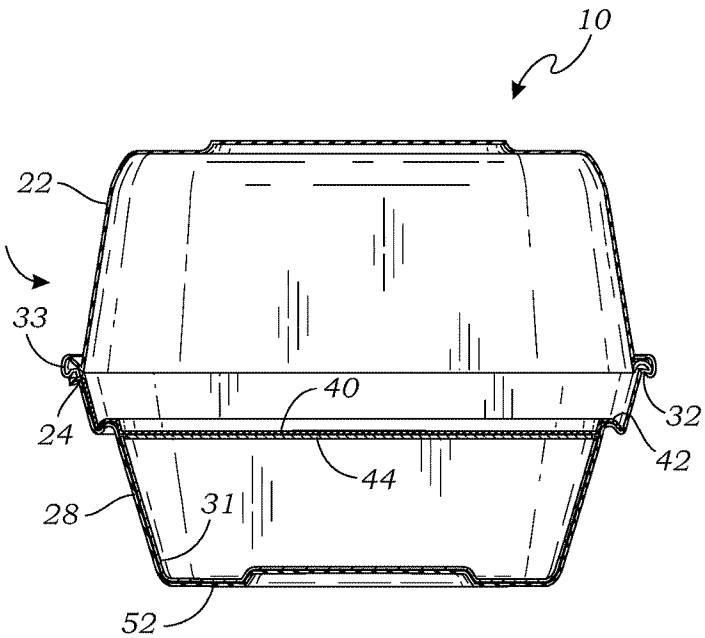
FIG. 5 is a sectional view thereof taken along line 5-5 in FIG. 4.
Figure 4:
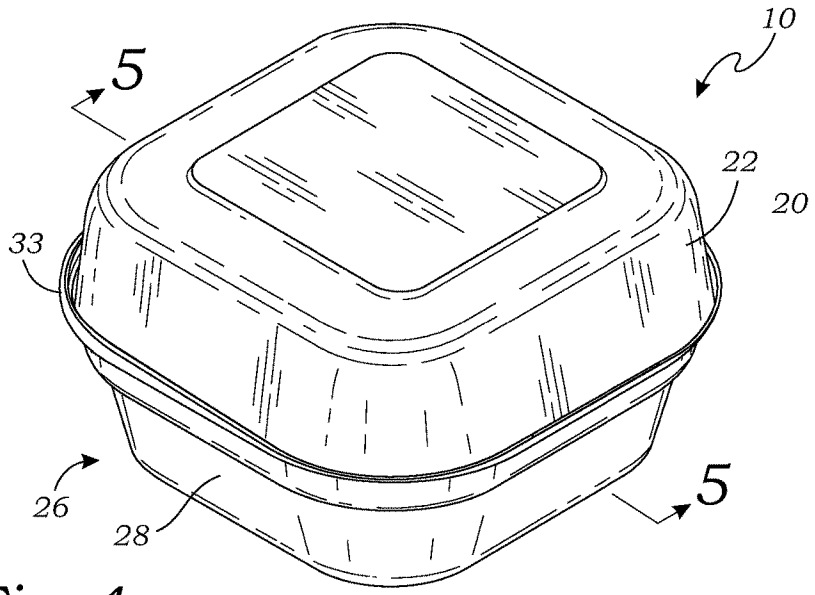
FIG. 4 is a perspective view of the sandwich container of FIG. 2, illustrating upper and lower shells moved to a closed configuration.

FIG. 1 is a perspective view of a sandwich container 10 according to a first embodiment of the present invention, illustrating an upper shell 20 and a lower shell 26 in an open configuration, and a divider panel 40 in a raised configuration. FIG. 2 is a perspective view thereof, illustrating the divider panel 40 moved to a lowered configuration. FIG. 3 is a sectional view thereof taken along line 3-3 in FIG. 2. FIG. 4 is a perspective view of the sandwich container 10 of FIG. 2, illustrating upper and lower shells 20 and 26 moved to a closed configuration. FIG. 5 is a sectional view thereof taken along line 5-5 in FIG. 4.

As shown in FIGS. 1-5, the upper shell 20 includes an upper sidewall 22 that extends to an upper perimeter 24. In this embodiment, the upper shell 20 is in the form of an open faced generally cuboid structure that is shaped to define an upper compartment for holding a portion of the sandwich, generally including bread, lettuce, and similar ingredients. In alternative embodiments, the upper shell 20 may be dome-shaped, or any alternative shape that is suitable for the described purpose. In this embodiment, the upper perimeter 24 is disposed on plane, although this may vary in alternative embodiments.

As shown in FIGS. 1-5, the lower shell 26 that includes a lower sidewall 28 that extends to a lower perimeter 30. In this embodiment, the lower shell 26 is in the form of an open faced generally cuboid structure that is shaped to define a lower compartment for holding a portion of the sandwich, generally including meat and other ingredients that are intended to be kept hot. In alternative embodiments, the lower shell 26 may be dome-shaped, or any alternative shape that is suitable for the described purpose. In this embodiment, the lower perimeter is disposed on plane, although this may vary in alternative embodiments. It is desired that the upper perimeter and the lower perimeter seat against each other in a secure manner, so obviously both perimeters may be non-planar, as long as they are complimentary in shape so as to seat securely against each other. In this embodiment, the lower perimeter 30 includes a C-shaped lip 33 that is shaped to securely receive and engage the upper perimeter 24, and may snap into and frictionally engage the upper perimeter 24.

For purposes of this invention, the terms "upper" and "lower" only refer to these particular drawings in the current embodiment, and do not restrict the scope of the present invention, and this orientation may be reversed and this should be considered within the scope of the present invention.

As shown in FIGS. 1-5, the sandwich container 10 includes a hinge 32 that connects the upper shell 20 and the lower shell 26 so that the upper shell 20 can pivot with respect to the lower shell 26 between the open configuration (shown in FIG. 1) and the closed configuration (shown in FIG. 4). In the open configuration, as shown in FIG. 1, the upper shell 20 and the lower shell 26 are opposite each other with both open faces facing upwardly for receiving the sandwich ingredients. In the closed configuration, as shown in FIGS. 4-5, the upper perimeter 24 seats against the lower perimeter 30, as described above.

In the embodiment of FIGS. 1-5, the lower sidewall 28 of the lower shell 26 may include an annular shelf 34. The annular shelf 34 may be formed where the lower sidewall shifts laterally outwardly, or alternatively the annular shelf 34 may be formed in alternative ways. The annular shelf 34 is separated a distance D1 from the lower perimeter 30 so that the lower sidewall 30 is separated into a lower portion 36 and an upper portion 38. The annular shelf 34 may be disposed on a plane, which may be parallel to the plane of the lower perimeter 30.

As shown in FIGS. 1-3, the sandwich container 10 further includes a divider panel 40 that extends to a divider perimeter 42. The divider panel 40 is sized and shaped so that the divider perimeter 42 seats against the annular shelf 34 when the divider panel 40 is positioned within the lower shell 26, such that the lower portion 36 of the lower shell 26 and the divider panel 40 together form a lower chamber. In this embodiment, the divider panel 40 is a generally planar structure, although other shapes may alternatively be used.

A thermal barrier 31 may be formed on the lower portion 36 of the lower shell 26, so that the lower chamber is thermally insulated. The thermal barrier 31 may be in the form of a sheet of foil or similar material, or it may be a layer of material that is sprayed or otherwise formed or deposited over the above-described surfaces. In some embodiments, the divider panel 40 may similarly include a thermal barrier 44, for further insulating the container 10.

As shown in FIGS. 1-5, an elongate hinge flap 46 connects the lower shell 26 and the divider panel 40. The elongate hinge flap 46 may be formed by any elongate construction, e.g., generally rectangular construction, or other shape of configuration, so long as it has a length D2 that is great enough to enable all of the divider perimeter 42 to be seated against the lower shell 26 beneath the lower perimeter 30 of the lower shell 26, and such that the divider panel 40 is contained entirely within the lower shell 26.

In the embodiment of FIG. 1, the elongate hinge flap 46 has a length D2 that is equal to the distance between the annular shelf 34 and the lower perimeter 30 of the lower shell 26, so that the divider panel 40 can pivot between a raised configuration wherein the divider panel 40 is outside of the lower shell 26, and a lowered configuration wherein the divider perimeter 42 is seated against the annular shelf 34. In the present embodiment, the upper shell 20, the hinge 32, the lower shell 26, the elongate hinge flap 46, and the divider panel 40 are all integrally formed as a single piece, such as via vacuum forming, or other suitable method known in the art. In alternative embodiments, these may be separate components, and connected using any method of connecting, interlocking, or fastening known in the art.

In one embodiment, as shown in FIGS. 1 and 2, the elongate hinge flap 46 is detachable to enable the detachment of the divider panel 40 from the lower shell 26. The elongate hinge flap 46 may be removably attached to either the divider panel 40 or the lower shell 26. In one embodiment, the elongate hinge flap 46 may be bisected by a perforated line 48. The perforated line 48 allows the elongate hinge flap 46 to be broken in two, for removal of the divider panel 40 from the lower shell 26.

Figure 6:
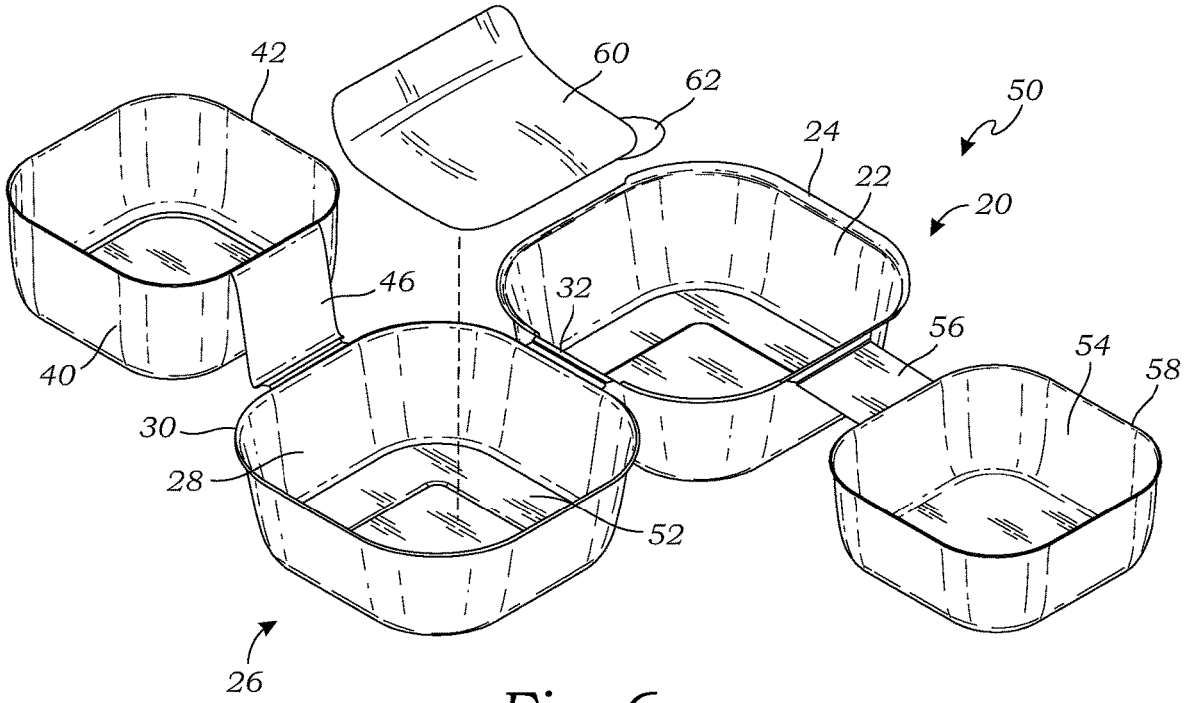
FIG. 6 is a perspective view of a second embodiment of the sandwich container, in an open and raised configuration similar to FIG. 1.
Figure 7:
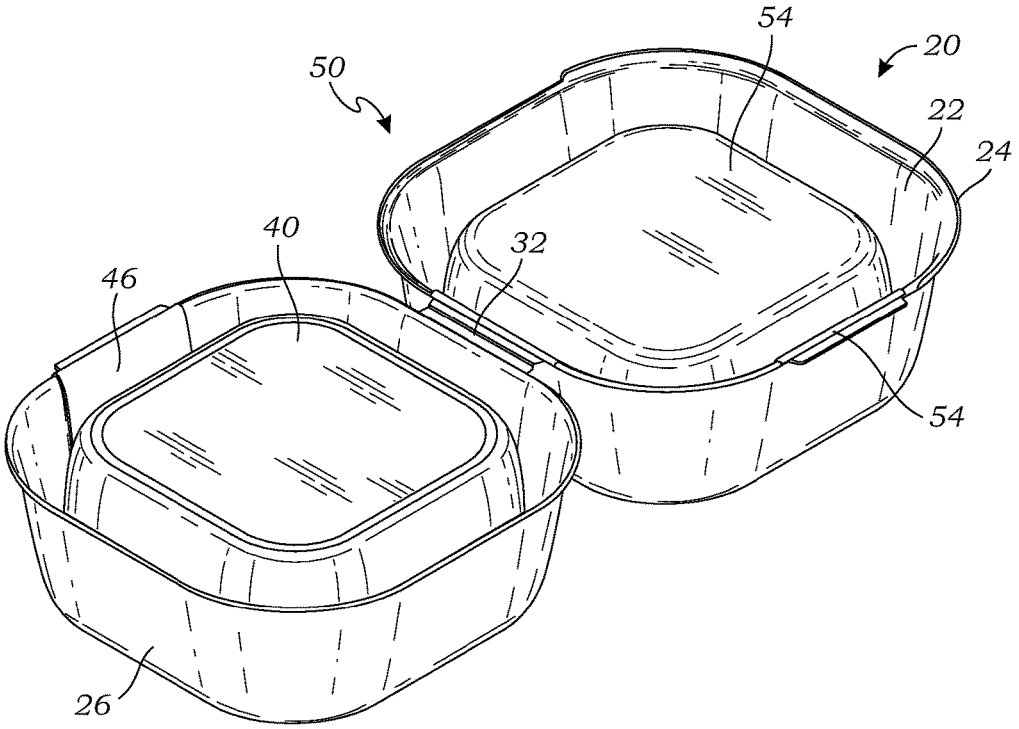
FIG. 7 is a perspective view thereof, illustrating the divider panel moved to a lowered configuration similar to FIG. 2.

FIG. 6 is a perspective view of a second embodiment of the sandwich container 50, in an open and raised configuration similar to FIG. 1. FIG. 7 is a perspective view thereof, illustrating the divider panel 40 moved to a lowered configuration similar to FIG. 2. As shown in FIGS. 6 and 7, in this embodiment the divider panel 40 is bowl-shaped, and the divider panel 40 has a depth. In this embodiment, the divider perimeter 42 is adapted to seat against a top panel portion 52 of the lower shell 26. In the embodiment of FIGS. 6-7, the elongate hinge flap 46 has a length that is at least long enough to extend from the lower perimeter 30 to the top panel portion 52 of lower shell 26, so that the divider perimeter 42 is able to seat against the top panel portion 52 of the lower shell 26.

In this embodiment, the entire divider panel 40 is positioned between the lower sidewall 38 of the lower shell 26, beneath the lower perimeter 30, when the divider panel 40 is in the lowered configuration. In alternative embodiments, the divider perimeter 42 may seat elsewhere, and portions of the divider panel 40 may extend upwardly above the lower perimeter 40, and such alternatives may also be considered within the scope of the present invention, unless expressly required in particular claim language.

In the embodiment of FIGS. 6 and 7, the sandwich container 10 further comprises a second divider panel 54 that is attached to the upper shell 20 with a second elongate hinge flap 56 that connects the upper perimeter 24 of the upper shell 20, and a second divider perimeter 58 of the second divider panel 54, so that the second divider panel 54 can pivot between a raised configuration wherein the second divider panel 54 is entirely outside of the upper shell 20, and a lowered configuration wherein the second divider panel 54 is contained entirely within the upper shell 20, the second elongate hinge flap 56 having a length that is great enough to enable all of the second divider perimeter 58 to be seated against the upper shell 20 beneath the upper perimeter 24.

In one embodiment, as illustrated in FIG. 6, the sandwich container 50 may further include a paper sheet 60 that extends to a sheet perimeter 62, that is shaped to fit within and substantially cover the lower shell 26. The paper sheet 60 is positioned within the lower shell 26, and may be bonded or otherwise fastened in place within the lower shell 26. The paper sheet 60 enables meat, cheese, and/or similar ingredients to be move easily lifted from the lower shell 26 when the user is ready to assemble and consume the sandwich (e.g., hamburger, etc.). The paper sheet 60 may be wax paper or any other suitable material, that is able to be used with hot food products, preferably without sticking.

As used in this application, the words "a," "an," and "one" are defined to include one or more of the referenced item unless specifically stated otherwise. The terms "approximately" and "about" are defined to mean +/−10%, unless otherwise stated. Also, the terms "have," "include," "contain," and similar terms are defined to mean "comprising" unless specifically stated otherwise. Furthermore, the terminology used in the specification provided above is hereby defined to include similar and/or equivalent terms, and/or alternative embodiments that would be considered obvious to one skilled in the art given the teachings of the present patent application. While the invention has been described with reference to at least one particular embodiment, it is to be clearly understood that the invention is not limited to these embodiments, but rather the scope of the invention is defined by the following claims.

What is claimed is:

1. A sandwich container comprising:

an upper shell and a lower shell connected with a hinge;

the lower shell having a top panel portion from which a lower sidewall extends to a lower perimeter;

a divider panel that is bowl-shaped and that extends to a divider perimeter;

an elongate hinge flap that connects the lower perimeter of the lower shell and the divider perimeter of the divider panel, so that the divider panel can pivot between a raised configuration wherein the divider panel is entirely outside of the lower shell, and a lowered configuration; and the elongate hinge flap having a length that is long enough to enable all of the divider perimeter to be seated against the top panel portion of the lower shell, beneath the lower perimeter of the lower shell, and such that the divider panel is contained entirely within the lower shell.

2. A sandwich container comprising:

an upper shell and a lower shell connected with a hinge;

the lower shell having a top panel portion from which a lower sidewall extends to a lower perimeter;

a divider panel that is bowl-shaped and that extends to a divider perimeter;

an elongate hinge flap that connects the lower perimeter of the lower shell and the divider perimeter of the divider panel, so that the divider panel can pivot between a raised configuration wherein the divider panel is entirely outside of the lower shell, and a lowered configuration;

the elongate hinge flap having a length that is long enough to enable all of the divider perimeter to be seated against the top panel portion of the lower shell, beneath the lower perimeter of the lower shell, and such that the divider panel is contained entirely within the lower shell; and further comprising a second divider panel that is attached to the upper shell with a second elongate hinge flap that connects the upper perimeter of the upper shell, and a second divider perimeter of the second divider panel, so that the second divider panel can pivot between a raised configuration wherein the second divider panel is entirely outside of the upper shell, and a lowered configuration wherein the second divider panel is contained entirely within the upper shell, the second elongate hinge flap having a length that is long enough to enable all of the second divider perimeter to be seated against the upper shell beneath the upper perimeter.

3. A sandwich container comprising:

an upper shell and a lower shell connected with a hinge;

the lower shell having a top panel portion from which a lower sidewall extends to a lower perimeter;

a divider panel that is bowl-shaped and that extends to a divider perimeter;

an elongate hinge flap that connects the lower perimeter of the lower shell and the divider perimeter of the divider panel, so that the divider panel can pivot between a raised configuration wherein the divider panel is entirely outside of the lower shell, and a lowered configuration;

the elongate hinge flap having a length that is long enough to enable all of the divider perimeter to be seated against the top panel portion of the lower shell, beneath the lower perimeter of the lower shell, and such that the divider panel is contained entirely within the lower shell; and a wax paper sheet that extends to a sheet perimeter, that is shaped to fit within and substantially cover the lower shell, the wax paper sheet being bonded within the lower shell.

* * * * *